US005203126A

United States Patent [19]

Sorenson et al.

[11] Patent Number: 5,203,126

[45] Date of Patent: Apr. 20, 1993

[54] SLIDABLE FOOT ASSEMBLY FOR COLLAPSIBLE DISPLAY

[75] Inventors: Gary R. Sorenson, Apple Valley; Philip C. Berberding, Hopkins, both of Minn.

[73] Assignee: Skyline Displays, Inc., Burnsville, Minn.

[21] Appl. No.: 718,593

[22] Filed: Jun. 21, 1991

[51] Int. Cl.[5] ..... E04B 1/68

[52] U.S. Cl. ..... 52/109; 52/646; 40/606; 40/610; 135/102

[58] Field of Search ..... 52/109, 646, 648, 81; 40/606-611; 135/102, 103, 109

[56] References Cited

U.S. PATENT DOCUMENTS

| | | | |
|---|---|---|---|
| 4,522,088 | 6/1985 | Zeigler | 52/646 |
| 4,557,082 | 12/1985 | Dunsworth | 52/109 |
| 4,561,618 | 12/1985 | Zeigler . | |
| 4,627,210 | 12/1986 | Beaulieu . | |
| 4,658,560 | 4/1987 | Beaulieu . | |
| 4,663,899 | 5/1987 | Nodskov et al. | 52/109 |
| 4,809,471 | 3/1989 | Wichman et al. | 52/109 |
| 4,986,016 | 1/1991 | Wichman | 52/109 |
| 5,078,284 | 1/1992 | Pirkl et al. . | |

*Primary Examiner*—Richard E. Chilcot, Jr.

*Attorney, Agent, or Firm*—Palmatier, Sjoquist & Helget

[57] ABSTRACT

A slidable foot assembly for stabilizing a collapsible display structure. Such structures include a network of support rods which form a skeletal frame for the structure and which are pivotally joined together by hub assemblies. The present foot assembly includes a slide which is elongate to extend to each of the sides of the erected structure to stabilize the structure and further includes feet affixed to a lower hub assembly and slidable in the slide to permit the slide to be disposed parallel to the collapsed form of the structure to maintain the compactness of the collapsed form.

19 Claims, 3 Drawing Sheets

SLIDABLE FOOT ASSEMBLY FOR COLLAPSIBLE DISPLAY

BACKGROUND OF THE INVENTION

The present invention relates to a collapsible display structure having a network of support rods which form a skeletal frame for the structure and which are pivotally joined together by hub assemblies. More particularly, the present invention relates to a slidable foot assembly for such a structure to provide stability to the structure while maintaining the compactness of the structure in its collapsed form.

Such collapsible display structures include a number of attractive features. For example, the network of support rods is collapsible to a small bundle for transportation and storage, yet is expandable to define a large backdrop for a trade show booth. In its expanded form, the network is sufficiently rigid for the attachment of shelves or lighting, but remains lightweight so as to be readily manually transported in a suitcase-like container in its compact form.

Another attractive feature of such a collapsible display is that it may be converted to provide the appearance of a solid backdrop. The network of support rods when expanded is typically covered by a skin-like shell to provide an aesthetically pleasing background, such as a skyline for the advertised product.

However, one problem is that the light weight of the collapsible display structure permits the expanded form to fall over when relatively light pressure is horizontally applied to the upper half of the display. Flat panel display structures are especially prone to such toppling. Curved display structures are resistant to being pushed over when a horizontal pressure is applied toward the center of the arc defined by the curve, but may nevertheless be easily pushed over when pressure is applied in the opposite direction.

SUMMARY OF THE INVENTION

An object of the present invention is to provide a relatively stable collapsible display structure.

Another object of the present invention is to provide a relatively stable collapsible display structure while maintaining the attractive features of collapsibility and lightness.

A feature of the present invention is a slidable foot assembly for connection to the bottom edge of a collapsible display structure. The slidable foot assembly includes a pair of feet fixed between a hub assembly of the display structure and an elongate track or slide laying at a right angle to the plane of the display structure to provide stability to the display structure against toppling. When the display structure is collapsed, the feet slide away from each other along the track, which then lays parallel to the bundle of support rods such that the display structure remains compact in its collapsed form. The slidable foot assembly further includes stops on the slide to retain the feet in the slide during the process of collapsing the structure and to orient approximately one-half of the track on its respective side of the display structure.

An advantage of the present invention is stability. With the elongate track extending from both sides of the collapsible display structure, the structure is relatively resistant to toppling.

Another advantage is that the collapsed form of the display structure is compact even with the addition of the slidable foot assembly. The elongate track that provides the stability to the expanded form stores in a parallel arrangement to the support rods of the display structure and thus occupies relatively little additional space.

Another advantage is that the slidable foot assembly remains on the display structure in both the expanded and compact forms and during the conversion of its display structure from one form to the other form.

Another advantage is that the slidable foot assembly is inexpensive to manufacture and easy to install, operate, and maintain.

DETAILED DESCRIPTION OF THE PREFERRED EMBODIMENTS

Figure 1:
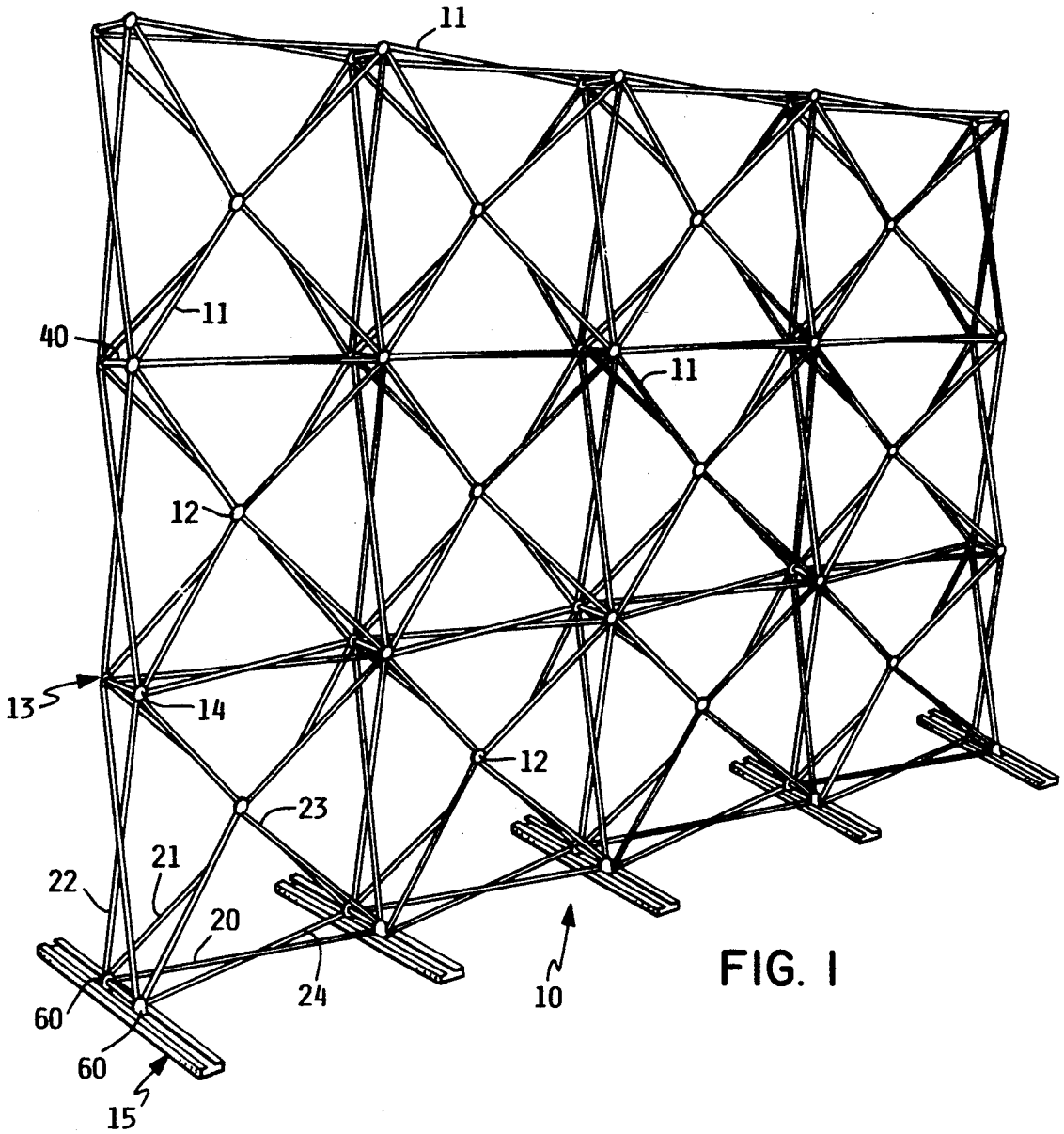
FIG. 1 is a perspective view of the present slidable foot assembly supporting a flat collapsible display structure.
Figure 2:
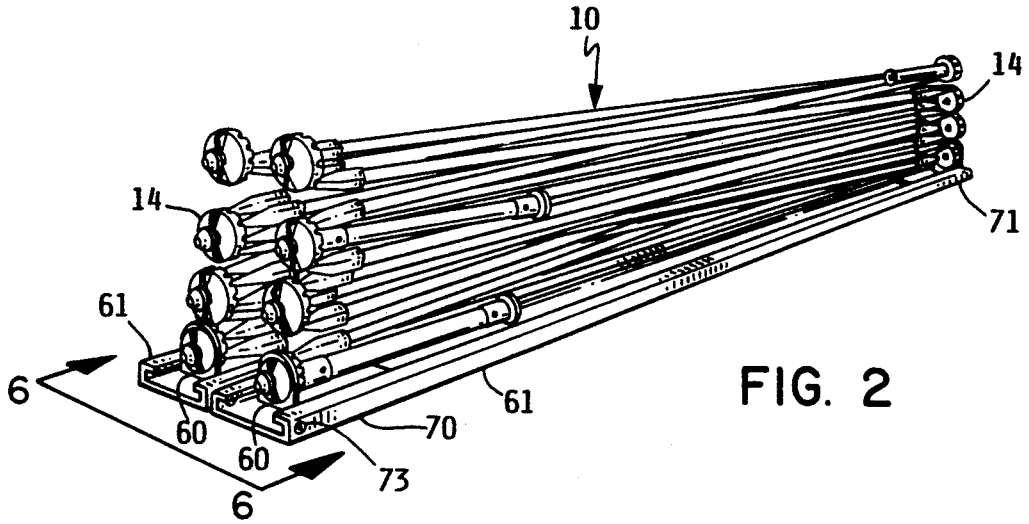
FIG. 2 is a perspective view of a portion of the collapsed compact form of the slidable foot assembly and display structure of FIG. 1.
Figure 4:
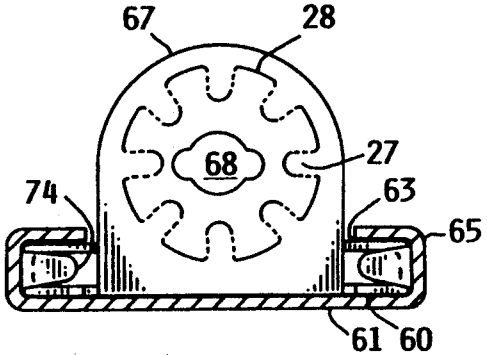
FIG. 4 is a section view at lines 4—4 of FIG. 3.

As shown in FIGS. 1 and 2, a collapsible display structure is indicated in general by the reference numeral 10. The collapsible display structure 10 includes as its principal components a network of support rods 11, single hubs 12, hub assemblies 13 having dual hubs 14, and a slidable foot assembly 15 connected to one of the hub assemblies 13. The display structure 10 is collapsible from the expanded form shown in FIG. 1 to a collapsed, compact form shown in FIG. 2.

Figure 3:
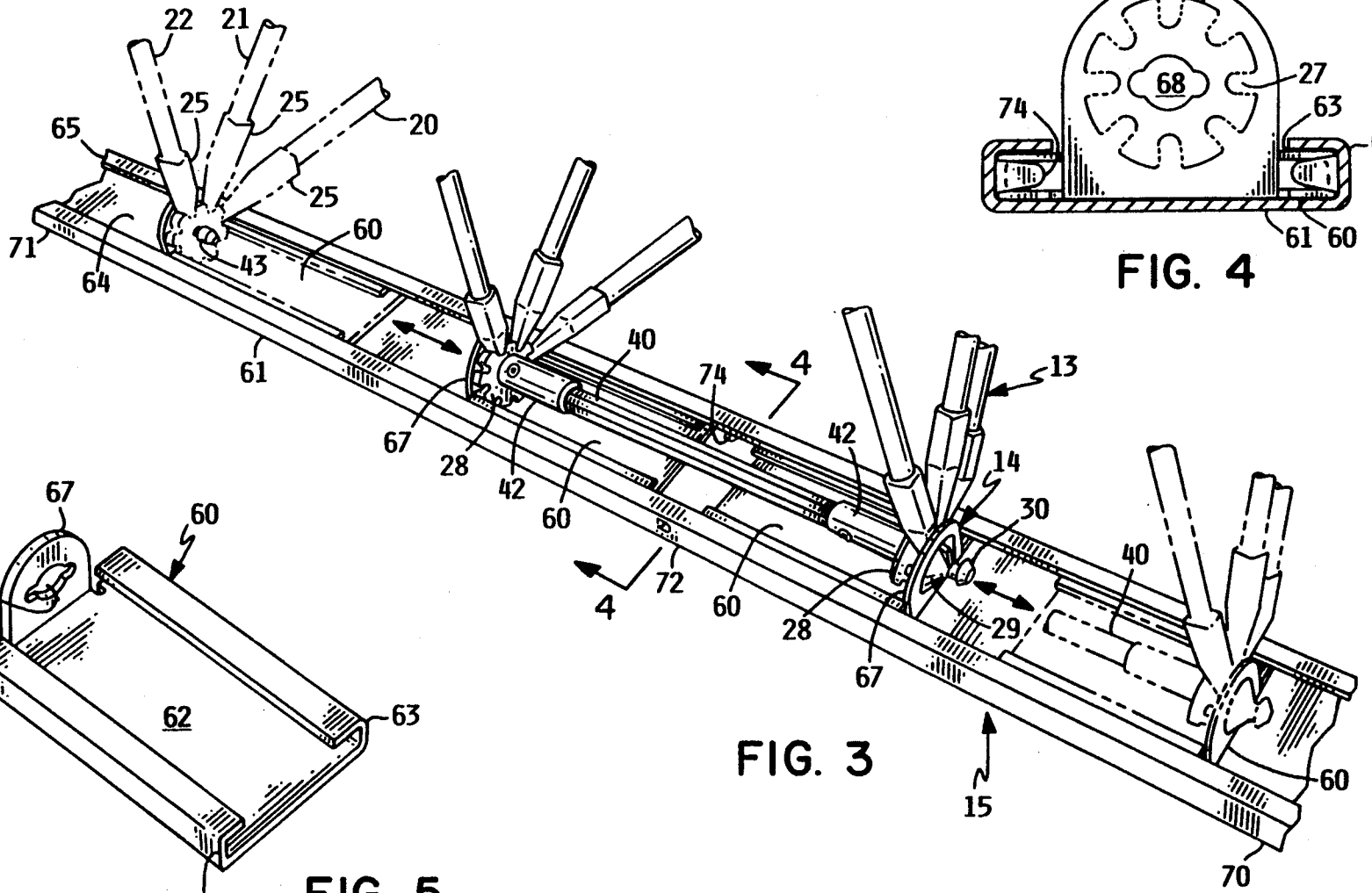
FIG. 3 is a detail perspective, partially phantom view of the slidable assembly of FIG. 1.
Figure 5:
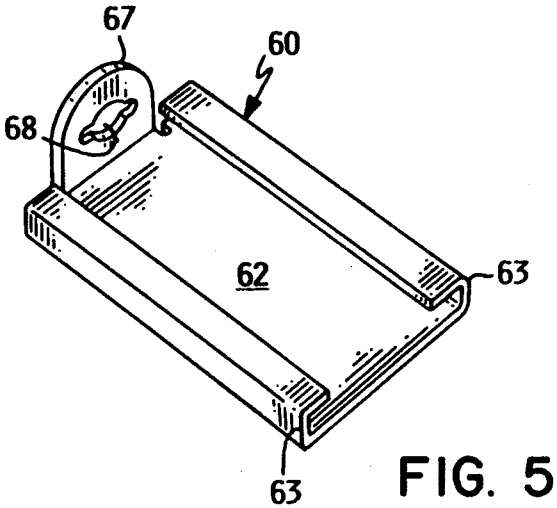
FIG. 5 is a detail perspective view of the foot of the slidable foot assembly of FIG. 1.
Figure 6:
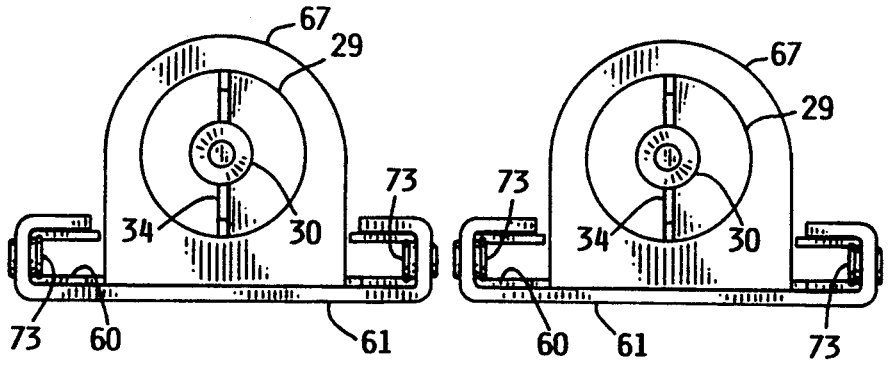
FIG. 6 is a partial end view at lines 6—6 of FIG. 2.

As shown in FIG. 3, the hub assembly 13 includes the two opposing hubs 14 for pivotally affixing three support rods 20, 21, 22. Rod 20 extends substantially horizontally. Rod 21 extends obliquely of rod 20. Rod 22 extends substantially vertically and at a right angle to rod 20. Each of the hubs 14 may secure another oblique rod 23 and another substantially horizontal rod 24, as shown in FIG. 1.

Figure 8:
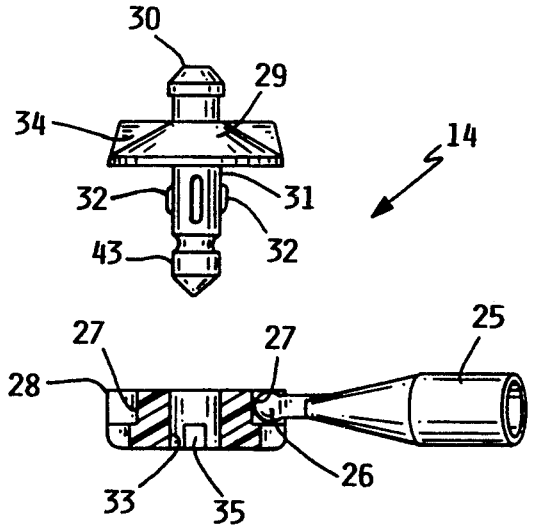
FIG. 8 is an exploded view of a hub that may be utilized with the collapsible display structure of FIG. 1.

As shown in FIGS. 3 and 8, each of the hubs 14 includes extension caps 25 for the support rods 11, spherical heads or balls 26 which fit in sockets 27 of a main, circular hub body 28. Hub 14 further includes a circular locking disk 29 which pivotally holds and prevents the heads 26 from lifting out of the sockets 27. Disk 29 includes a fastening button 30 and a bayonet 31 with knobs 32 to align the bayonet 31 with an opening 33 in the hub body 28. After the bayonet 31 is inserted into the opening 33, the disk 29 is twisted via a handle 34 to lock the knobs 32 in locking notches 35 of the hub body 28. As to the hub 14 including such a ball-and-socket arrangement, U.S. Pat. No. 4,627,210 is hereby incorporated by reference.

The hubs 14 of the hub assembly 13 are interconnected by a rod fastener 40 to hold the display structure in its expanded form. At both of its ends, the rod fastener 40 includes a female receptacle snap connector 42 which engages a male snap connector 43 affixed to and extending from the bayonet 31.

As shown in FIGS. 3–6, the slidable foot assembly 15 includes a pair of feet 60, each of which is secured to one of the hubs 14 of the hub assembly 13 and each of which slides in a track or slide 61. The foot 60 includes a main plate 62 and U-shaped flanges 63. Such a foot 60 is thus tailored to ride or slide longitudinally in the similarly cross-sectionally shaped slide 61 which includes an elongate main plate 64 and channel-forming U-shaped flanges 65. Engagement of flanges 63 in flanges 65 limits side-to-side and vertical movement of the foot 60 in the slide 61.

Foot 60 further includes an upright plate 67 for engaging one of the hubs 14 of the hub assembly 13. The plate 67 includes a keyhole-like aperture 68 for permitting alignment and passage of the bayonet 31 and its knobs 32. The upright plate 67 is pinched or locked between the circular locking disk 29 and its respective main hub body 28 when the knobs 32 of the bayonet 31 engage locking notches 35. In such a position, the plate 67 instead of the circular disk 29 prevents the heads 26 from lifting out of the sockets 27.

The slide 61 includes two end portions 70, 71 and medial portion 72. Each of the two end portions 70, 71 include stop pins 73 fixed to the flanges 65 and expanding inwardly to act as stops to prevent the feet 60 from sliding out of the slide 61 when the display structure 10 is collapsed. The medial portion 72 includes integral stop dimples or stop tabs 74 punched out of the flanges 65 and extending inwardly for engagement of the feet 60. The stop tabs 74 maintain each of the feet 60 on one-half of the slide 61 such that each half of the slide 61 is oriented on one side of the collapsible display structure 10.

In operation, when the collapsible display is in its expanded form as shown in FIG. 1, with the rod fasteners 40 connecting the hubs 14 of the hub assemblies 13, the elongate slides 61 act to stabilize the collapsible display structure 10 against falling over while still in its expanded form. While in such an expanded form, the medial stop 74 maintains each of the feet 60 on one side of the slide 61 to dispose one-half of the slide 61 on each of the sides of the display structure 10, as the slide 61 may have a tendency by its nature to slide such as when the display structure 10 is lifted and moved in the trade show booth. When the display structure 10 is to be collapsed, one end of each of the rod fasteners 40 of the hub assemblies 13 is disconnected to disconnect the hubs 14 relative to each other, and the feet 60 thus subsequently slide apart from each other in the slide 61 as the structure 10 is being collapsed. In the collapsed form of the display structure 10, the elongate slide 61 is disposed substantially parallel to the support rods 11 as shown in FIG. 2.

Figure 7:
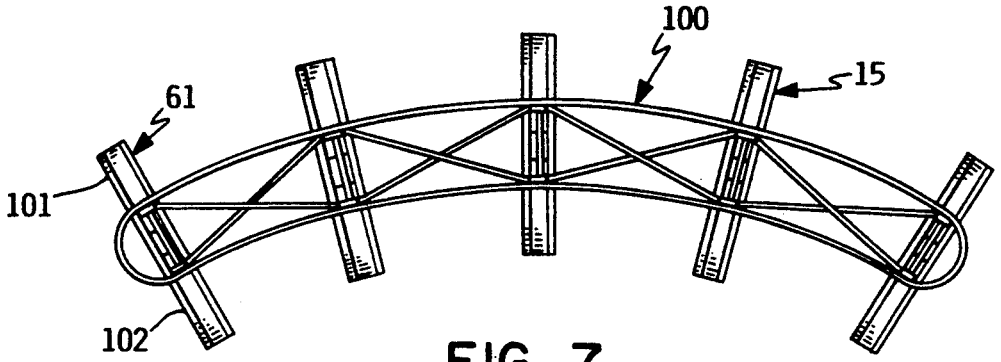
FIG. 7 is a top plan view of the slidable foot assembly on a curved collapsible display structure.

As shown in FIG. 7, a curved collapsible display structure 100 includes the slidable foot assemblies 15 as previously described. The curved display structure 100 is resistant to being pushed over when pressure is applied away from the center of the arc defined by the curve by virtue of the slidable foot assembly 15. This resistance is typically supplied by the rear portion 101 of each of the elongate slides 61. By its nature, the curved structure 100 is resistant to being pushed over when pressure is applied toward the center of the arc defined by the curve, but a second portion 102 of the elongate slide 61 increases the resistance to such toppling.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A slidable foot assembly for supporting a collapsible display structure having a network of support rods which form a skeletal frame for the structure and which are pivotally joined together by hub assemblies, at least one lower hub assembly being adjacent to a surface on which the structure stands, the structure having erected and collapsed forms, the slidable foot assembly comprising:

a) elongate means connected to the structure adjacent the lower hub assembly for supporting the structure by engagement with the surface, the elongate means being disposed at a substantial angle to a plane of the erected form of the structure to stabilize the structure on the surface and being in generally parallel relationship with the collapsed form of the structure to maintain the compactness of the collapsed form, and b) slidable engagement means between the elongate means and the structure for slidably fixing the elongate means relative to the structure whereby the erected form of structure is stabilized and the elongate means remains on both the erected and collapsed forms of the structure.

2. The slidable foot assembly according to claim 1, wherein the elongate means includes means for centering the elongate means relative to the structure.

3. The slidable foot assembly according to claim 1, and the elongate means including means for stopping sliding of the slidable engagement means relative to the elongate means.

4. The slidable foot assembly according to claim 1, wherein the slidable engagement means is affixed to the lower hub assembly.

5. The slidable foot assembly according to claim 1, wherein the elongate means includes a slide with a channel and the slidable engagement means includes a foot engaging the channel, the foot being affixed in the channel.

6. A slidable foot assembly for supporting a collapsible display structure having a network of support rods which form a skeletal frame for the structure and which are pivotally joined together by hub assemblies, at least one lower hub assembly being adjacent to a surface on which the structure stands, the structure having erected and collapsed forms, the slidable foot assembly comprising:

a) a first foot connectable to a first portion of the lower hub assembly, and b) a first elongate slide connected to the structure adjacent the lower hub assembly for supporting the structure, the first foot slidably engaging the slide, the first elongate slide being disposed at a substantial angle to a plane of the erected form of the structure to stabilize the structure and in generally parallel relationship with the collapsed form of the structure to maintain the compactness of the collapsed form.

7. The slidable foot assembly according to claim 6, and further comprising a second foot connectable to a second portion of the lower hub assembly, the second foot slidably engaging the elongate slide.

8. The slidable foot assembly according to claim 6, wherein the elongate slide includes an end stop to prevent the foot from sliding out of the slide.

9. The slidable foot assembly according to claim 6, wherein the elongate slide includes a medial stop to retain the foot in one portion of the slide to orient the slide relative to the foot and structure when the structure is in its erected form.

10. The slidable foot assembly according to claim 6 and the lower hub assembly including a pair of hubs, wherein the first foot is connectable to one of the hubs.

11. The slidable foot assembly according to claim 7 and the lower hub assembly including a pair of hubs, wherein each of the feet is connectable to one of the hubs.

12. The slidable foot assembly according to claim 11 and the lower hub assembly including a rod fastener extending between the hubs to fix the hubs relative to one another.

13. The slidable foot assembly according to claim 6 and including a second lower hub assembly, and further comprising a second elongate slide slidably connected to the structure adjacent the second lower hub assembly.

14. The slidable foot assembly according to claim 13, wherein the elongate slides extend parallel to each other.

15. The slidable foot assembly according to claim 13, wherein the elongate slides extend obliquely of one another.

16. The slidable foot assembly according to claim 6, wherein the slide includes a channeled member with opposing parallel, elongated flanges for retaining the first foot in the channeled member.

17. A stabilizing assembly for supporting a collapsible display structure having a network of support rods which form a skeletal frame for the structure and which are pivotally joined together by hub assemblies, at least one lower hub assembly being adjacent to a surface on which the structure stands, the structure having erected and collapsed forms, the stabilizing assembly comprising:

an elongate stabilizer connectable to the structure adjacent to the lower hub assembly and at a substantial angle to a plane of the erected form of the structure for engaging the surface to stabilize the structure against being toppled; and slidable means affixed between the stabilizer and the structure for slidably engaging the stabilizer relative to the structure such that the stabilizer is disposed at the substantial angle to the erected form of the structure to stabilize the structure and in generally parallel relationship with the collapsed form of the structure to maintain the compactness of the collapsed form.

18. The stabilizing assembly according to claim 17, wherein the slidable means is affixed to the lower hub assembly.

19. A slidable foot assembly for supporting a collapsible display structure having a network of support rods which form a skeletal frame for the structure and which are pivotally joined together by hub assemblies, each of the hub assemblies having two hubs, at least one lower hub assembly being adjacent to a surface on which the structure stands, the structure having erected and collapsed forms, the slidable foot assembly comprising:

a) a pair of feet connectable to the lower hub assembly, each of the feet connectable to one of the hubs of the lower hub assembly, each of the feet comprising an upright plate connectable to its respective hub and a lower plate integrally connected to the upright plate at generally a right angle, and b) an elongate slide connectable to the structure to the lower hub assembly, the slide being engaged by the feet, the slide comprising a pair of channel portions formed at least in part by integral, opposing elongate lips for retaining the lower plate which is slidable in the slide, the slide further comprising a pair of end portions and a medial prison, each of the portions having a pair of integral tabs extending into the channel portions to retain each of the feet between one of the end portions and the medial portion such that the feet are prevented from sliding out of the slide when the structure is in its collapsed form and such that the slide is oriented to extend to each of the sides of the structure in its erected form whereby the slide is disposed at a generally right angle to the erected form of the structure to stabilize the structure and in generally parallel relationship with the collapsed form of the structure to maintain the compactness of the collapsed form.

* * * * *

UNITED STATES PATENT AND TRADEMARK OFFICE

CERTIFICATE OF CORRECTION

PATENT NO. : 5,203,126
DATED : April 20, 1993
INVENTOR(S) : Gary R. Sorenson, et. al.

It is certified that error appears in the above-indentified patent and that said Letters Patent is hereby corrected as shown below:

On the Title page, item [75] Inventors: the inventor's name "Philip C. Berberding" should be -- Philip C. Gerberding --.

Signed and Sealed this

Twenty-first Day of December, 1993

*Attest:*

Bruce Lehman

BRUCE LEHMAN

*Attesting Officer*

*Commissioner of Patents and Trademarks*